US011636806B2

(12) United States Patent
Choi

(10) Patent No.: US 11,636,806 B2
(45) Date of Patent: Apr. 25, 2023

(54) PIXEL SENSING DEVICE AND PANEL DRIVING DEVICE FOR SENSING CHARACTERISTICS OF PIXELS

(71) Applicant: LX Semicon Co., Ltd., Daejeon (KR)

(72) Inventor: Jung Min Choi, Daejeon (KR)

(73) Assignee: LX SEMICON CO., LTD., Daejeon (KR)

( * ) Notice: Subject to any disclaimer, the term of this patent is extended or adjusted under 35 U.S.C. 154(b) by 0 days.

(21) Appl. No.: 17/504,241

(22) Filed: Oct. 18, 2021

(65) Prior Publication Data

US 2022/0139320 A1 May 5, 2022

(30) Foreign Application Priority Data

Oct. 29, 2020 (KR) ..... 10-2020-0141989

(51) Int. Cl.
*G09G 3/3233* (2016.01)
*G09G 3/3275* (2016.01)

(52) U.S. Cl.
CPC ..... *G09G 3/3233* (2013.01); *G09G 3/3275* (2013.01); *G09G 2310/0272* (2013.01); *G09G 2310/0291* (2013.01); *G09G 2320/0626* (2013.01)

(58) Field of Classification Search
CPC ..... G09G 3/3233
USPC ..... 345/76
See application file for complete search history.

(56) References Cited

U.S. PATENT DOCUMENTS

| | | | | |
|---|---|---|---|---|
| 2016/0012798 | A1* | 1/2016 | Oh | G09G 3/3283 345/82 |
| 2018/0204516 | A1* | 7/2018 | Hwang | G09G 3/3233 |
| 2020/0175923 | A1* | 6/2020 | Kim | G09G 3/3275 |

FOREIGN PATENT DOCUMENTS

| | | | |
|---|---|---|---|
| JP | 2017-538158 | A | 12/2017 |
| KR | 10-1560417 | B1 | 10/2015 |
| KR | 10-1675395 | B1 | 11/2016 |
| KR | 10-2018-0025512 | A | 3/2018 |
| KR | 10-1929790 | B1 | 12/2018 |
| WO | WO 2016/077887 | A1 | 5/2016 |

* cited by examiner

*Primary Examiner* — Long D Pham
(74) *Attorney, Agent, or Firm* — Rothwell, Figg, Ernst & Manbeck, P.C.

(57) ABSTRACT

An embodiment relates to a pixel sensing technique. By supplying a precharge voltage to a sensing line using an amplifier used in pixel sensing, it is possible to minimize differences between precharge voltages of sensing lines and solve a crosstalk problem between the sensing lines, while not increasing a size of a pixel sensing device.

16 Claims, 9 Drawing Sheets

PIXEL SENSING DEVICE AND PANEL DRIVING DEVICE FOR SENSING CHARACTERISTICS OF PIXELS

CROSS REFERENCE TO RELATED APPLICATION

This application claims priority from Korean Patent Application No. 10-2020-0141989, filed on Oct. 29, 2020, which is hereby incorporated by reference for all purposes as if fully set forth herein.

BACKGROUND

1. Technical Field

Various embodiments generally relate to a pixel sensing technique, and more particularly, to a technique for improving the performance of a pixel sensing circuit.

2. Related Art

A display device includes a source driver for driving pixels disposed in a panel.

The source driver determines data voltages according to image data and supplies the data voltages to pixels, thereby controlling the brightness of the respective pixels.

Although the same data voltage is supplied, the brightness of respective pixels may vary depending on the characteristics of the pixels. For example, each pixel includes a driving transistor. If a threshold voltage of the driving transistor varies, the brightness of the pixel varies even though the same data voltage is supplied. If the source driver does not consider such variations in the characteristics of the pixels, problems may be caused in that the pixels are driven to undesired brightness and image quality is degraded.

In detail, the characteristics of the pixels vary over time or depending on a surrounding environment. If the source driver supplies the data voltages without considering the varied characteristics of the pixels, a problem is caused in that image quality is degraded (for example, a problem such as a screen spot is caused).

In order to solve the problem such as a degradation in image quality, the display device may include a pixel sensing device which senses the characteristics of the pixels.

The pixel sensing device may receive a sensing signal of each pixel through a sensing line which is connected to the pixel. The pixel sensing device converts the sensing signal into sensing data, and transmits the sensing data to a timing controller. The timing controller grasps the characteristic of each pixel through the sensing data. By compensating image data through reflecting the characteristic of each pixel, the timing controller may solve the problem caused by a degradation in image quality due to a deviation in the characteristics of the pixels.

Meanwhile, the pixel sensing device may receive the sensing signal from each pixel after charging the sensing line to a predetermined voltage. The predetermined voltage may be referred to as a precharge voltage.

The precharge voltage may be supplied to a plurality of sensing lines through one supply line. In general, the precharge voltage may be supplied to both ends of the supply line, and the plurality of sensing lines may be connected from the supply line to different positions so that the precharge voltage is supplied to the respective sensing lines. As the plurality of sensing lines are connected to the one supply line, a deviation may occur in precharge voltages supplied to the respective sensing lines. Line resistance is formed in the supply line, and a voltage drop occurs due to the line resistance. Thus, a deviation occurs in the precharge voltages supplied to the respective sensing lines. A deviation in the precharge voltages of the respective sensing lines may cause a sensing deviation in the respective sensing lines, and such a sensing deviation may cause a defect in image quality such as a line dim and a block dim.

In addition, such a conventional pixel sensing scheme may cause a crosstalk problem between sensing lines. At least two sensing lines may be simultaneously supplied with a precharge voltage from one supply line. As the current of one sensing line flows to the other sensing line through the supply line, the crosstalk problem may be caused. Such a crosstalk problem between sensing lines may make sensing compensation inaccurate, and may cause a degradation in image quality.

SUMMARY

Under such a background, in one aspect, various embodiments are directed to providing a technique for increasing the accuracy of pixel sensing. In another aspect, various embodiments are directed to providing a technique for minimizing a deviation in precharge voltages of respective sensing lines. In still another aspect, various embodiments are directed to providing a technique for solving a crosstalk problem between sensing lines. In yet another aspect, various embodiments are directed to providing a technique for achieving the above objects while minimizing an increase in the size of a pixel sensing device.

In an aspect, an embodiment may provide a pixel sensing device for sensing a pixel, disposed in a panel, through a sensing line, including: an amplifier configured to output a precharge voltage to the sensing line during a first time, and receive a sensing signal, formed in the pixel, through the sensing line and output the received sensing signal as a sensing voltage during a second time; an analog-to-digital converter configured to convert the sensing voltage into digital data; and a transmitting circuit configured to transmit the digital data to a device which compensates image data for the pixel.

In another aspect, an embodiment may provide a panel driving device for driving a panel in which a plurality of pixels are disposed and a plurality of data lines and a plurality of sensing lines connected to the pixels are disposed, including: a data driving circuit configured to convert image data into a data voltage and supply the data voltage to the data line; a pixel sensing circuit configured to generate sensing data corresponding to a sensing signal formed in the pixel; and a data processing circuit configured to compensate the image data using the sensing data, wherein the pixel sensing circuit includes an amplifier which, during a first time, outputs a precharge voltage to the sensing line connected to the pixel and, during a second time, receives the sensing signal, formed in the pixel, through the sensing line and outputs the sensing signal to an analog-to-digital converter.

As is apparent from the above description, according to the embodiments, it is possible to increase the accuracy of pixel sensing by minimizing a deviation between respective sensing lines. Also, according to the embodiments, it is possible to minimize a deviation in precharge voltages of respective sensing lines and solve a crosstalk problem between sensing lines. Further, according to the embodiments, it is possible to achieve the above effects while minimizing an increase in the size of a pixel sensing device.

DETAILED DESCRIPTION

Figure 1:
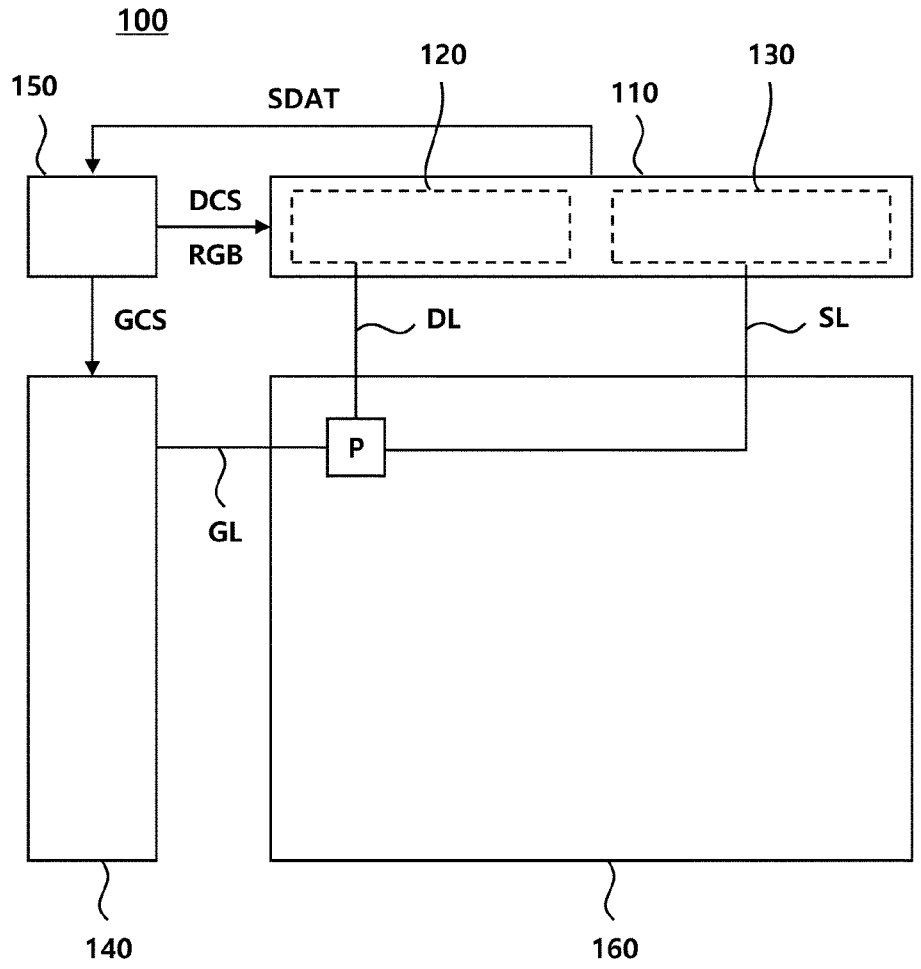
FIG. 1 is a configuration diagram of a display device in accordance with an embodiment.

FIG. 1 is a configuration diagram of a display device in accordance with an embodiment.

Referring to FIG. 1, the display device 100 may include a panel 160 and a panel driving device 120, 130, 140 and 150 which drives the panel 160.

In the panel 160, a plurality of data lines DL, a plurality of gate lines GL and a plurality of sensing lines SL may be disposed, and a plurality of pixels P may be disposed.

The panel driving device may be configured by a data driving circuit 120, a sensing circuit 130, a gate driving circuit 140 and a data processing circuit 150.

In the panel driving device, the gate driving circuit 140 may supply a scan signal having a turn-on voltage or a turn-off voltage to a gate line GL. When the scan signal having a turn-on voltage is supplied to each pixel P, the corresponding pixel P is connected to a data line DL, and when the scan signal having a turn-off voltage is supplied to each pixel P, the connection between the corresponding pixel P and the data line DL is released.

In the panel driving device, the data driving circuit 120 supplies a data voltage to the data line DL. The data voltage supplied to the data line DL is transferred to the pixel P which is connected to the data line DL depending on the scan signal.

In the panel driving device, the sensing circuit 130 receives a sensing signal (for example, a voltage or a current as an electrical signal) formed in each pixel P. The sensing circuit 130 may be connected to each pixel P depending on the scan signal, or may be connected to each pixel P depending on a separate sensing scan signal. The sensing scan signal may be generated by the gate driving circuit 140.

In the panel driving device, the data processing circuit 150 may supply various control signals to the gate driving circuit 140 and the data driving circuit 120. The data processing circuit 150 may generate a gate control signal GCS which causes a scan to be started according to a timing implemented in each frame, and may transmit the gate control signal GCS to the gate driving circuit 140. The data processing circuit 150 may convert image data, inputted from the outside, into image data RGB in conformity with a data signal format used in the data driving circuit 120, and may output the image data RGB to the data driving circuit 120. Also, the data processing circuit 150 may transmit a data control signal DCS which controls the data driving circuit 120 to supply a data voltage to each pixel P in conformity with each timing.

The data processing circuit 150 may compensate the image data RGB according to the characteristic of each pixel P, and may transmit the compensated image data RGB. In this regard, the data processing circuit 150 may receive sensing data SDAT from the sensing circuit 130. The sensing data SDAT may include a measurement value for the characteristic of the pixel P.

The data driving circuit 120 may be referred to as a source driver. The gate driving circuit 140 may be referred to as a gate driver. The data processing circuit 150 may be referred to as a timing controller. The data driving circuit 120 and the sensing circuit 130 may be included in one integrated circuit 110, and may be referred to as a source driver IC or a pixel sensing device. The data driving circuit 120, the sensing circuit 130 and the data processing circuit 150 may be included in one integrated circuit, and may be referred to as an integrated IC. The present embodiment is not limited by such names, and in the following description for embodiments, description of some components generally known in the source driver, the gate driver and the timing controller will be omitted. Therefore, it should be considered in the understanding of an embodiment that these components are omitted.

The panel 160 may be an organic light-emitting display panel. Each of the pixels P disposed in the panel 160 may include an organic light-emitting diode (OLED) and at least one transistor. The characteristics of the OLED and the transistor included in each pixel P may vary over time or depending on a surrounding environment. The sensing circuit 130 according to the embodiment may sense the characteristics of such components included in each pixel P, and may transmit the sensed characteristics to the data processing circuit 150.

Figure 2:
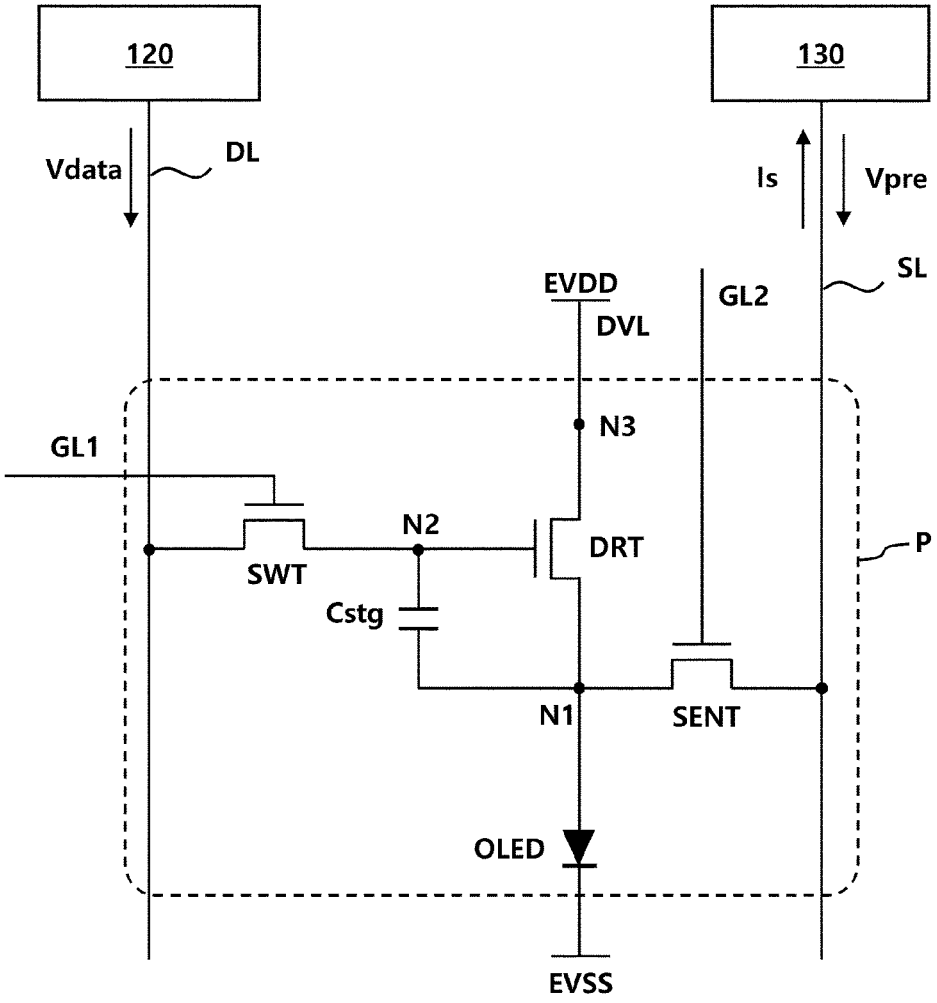
FIG. 2 is a diagram illustrating a structure of each pixel in FIG. 1 and signals inputted and outputted between a data driving circuit and a sensing circuit and the pixel.

FIG. 2 is a diagram illustrating a structure of each pixel in FIG. 1 and signals inputted and outputted between a data driving circuit and a sensing circuit and the pixel.

Referring to FIG. 2, the pixel P may include an organic light-emitting diode OLED, a driving transistor DRT, a switching transistor SWT, a sensing transistor SENT and a storage capacitor Cstg.

The organic light-emitting diode OLED may be configured by an anode electrode, an organic layer and a cathode electrode. As the anode electrode and the cathode electrode are connected to a driving voltage EVDD and a base voltage EVSS, respectively, under the control of the driving transistor DRT, the organic light-emitting diode OLED emits light.

The driving transistor DRT may control the brightness of the organic light-emitting diode OLED by controlling a driving current supplied to the organic light-emitting diode OLED.

A first node N1 of the driving transistor DRT may be electrically connected to the anode electrode of the organic light-emitting diode OLED, and may be a source node or a drain node. A second node N2 of the driving transistor DRT may be electrically connected to a source node or a drain node of the switching transistor SWT, and may be a gate node. A third node N3 of the driving transistor DRT may be electrically connected to a driving voltage line DVL which supplies the driving voltage EVDD, and may be a drain node or a source node.

The switching transistor SWT may be electrically connected between the data line DL and the second node N2 of the driving transistor DRT, and may be turned on by receiving a scan signal through a first gate line GL1.

When the switching transistor SWT is turned on, a data voltage Vdata supplied through the data line DL from the data driving circuit 120 is transferred to the second node N2 of the driving transistor DRT.

The storage capacitor Cstg may be electrically connected between the first node N1 and the second node N2 of the driving transistor DRT.

The storage capacitor Cstg may be a parasitic capacitor which exists between the first node N1 and the second node N2 of the driving transistor DRT, or may be an external capacitor which is intentionally designed outside the driving transistor DRT.

The sensing transistor SENT may connect the first node N1 of the driving transistor DRT and the sensing line SL. The sensing line SL may transfer a precharge voltage Vpre to the first node N1, and may transfer a characteristic value (for example, a voltage or a current) of the first node N1 to the sensing circuit 130.

The sensing circuit 130 measures the characteristic of the pixel P using a sensing signal Is which is transferred through the sensing line SL.

The sensing circuit 130 may transmit sensing data, generated according to a characteristic measurement value of the pixel P, to the data processing circuit 150 (see FIG. 1). The data processing circuit 150 (see FIG. 1) may grasp the characteristic of each pixel P by analyzing the sensing data.

A plurality of channels may be disposed in a sensing circuit, and may simultaneously sense a plurality of pixels while being connected to a plurality of sensing lines, respectively. However, in such simultaneous sensing, the accuracy of pixel sensing may decrease as a deviation occurs in the precharge voltages Vpre of the sensing lines to which the channels are connected, respectively, or a crosstalk occurs between the sensing lines.

Figure 3:
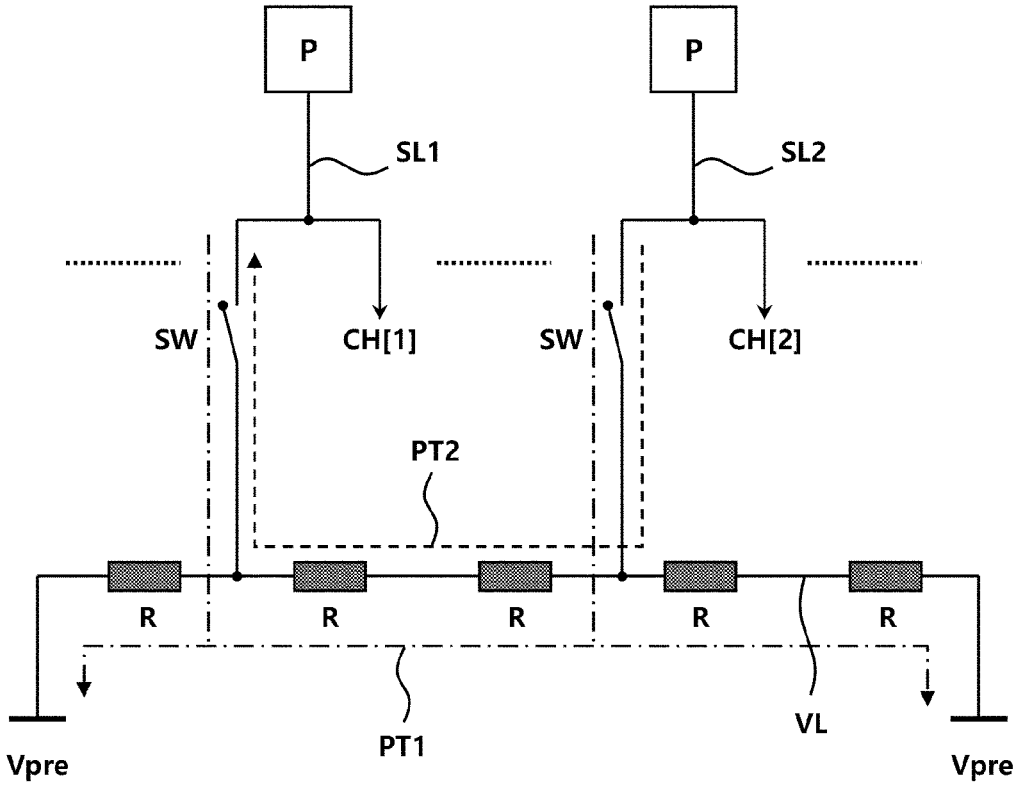
FIG. 3 is a diagram illustrating a problem caused when two channels simultaneously sense pixels in a general sensing circuit.

FIG. 3 is a diagram illustrating a problem caused when two channels simultaneously sense pixels in a general sensing circuit.

Referring to FIG. 3, the sensing circuit may simultaneously supply a precharge voltage Vpre to two channels CH[1] and CH[2] through one supply line VL. When sensing of pixels P is started, switches SW may be closed (turned on), and the precharge voltage Vpre may be supplied to sensing lines SL1 and SL2 through the supply line VL.

The precharge voltage Vpre is supplied from both ends of the supply line VL. Since there is line resistance R in the supply line VL, the precharge voltages Vpre having different voltage levels may be supplied to the sensing lines SL1 and SL2, respectively. Such a deviation in the precharge voltages Vpre may cause a sensing error and result in a degradation in image quality.

In order to solve this problem, a designer may increase the width of the supply line VL. When the width of the supply line VL is increased, the line resistance R may decrease, and a problem caused due to a deviation in the precharge voltages Vpre may be solved to some extent. This technique may also be applied to the present embodiment. However, if the width of the supply line VL is excessively increased, a problem may be caused in that the size of the sensing circuit increases. Thus, an increase in the width of the supply line VL may be limited to a certain level.

As one of other methods for decreasing a deviation in the precharge voltages Vpre, a method of adding amplifiers (for example, buffers) to both ends of the supply line VL may be suggested.

The sensing lines SL1 and SL2 are capacitive loads rather than resistive loads. Therefore, the precharge voltages Vpre initially formed in the sensing lines SL1 and SL2 may have a deviation due to the line resistance R, but the deviation may decrease after a time according to an RC time constant elapses. This is a result that occurs because the sensing lines SL1 and SL2 are capacitive loads. However, because a sensing time is short, sensing is performed before all the sensing lines SL1 and SL2 are charged, and accordingly, a deviation in the precharge voltages Vpre is recognized in sensing.

When amplifiers are added to both ends of the supply line VL, the current supply capability is improved, and thus, charging times of the sensing lines SL1 and SL2 are reduced. As a result, a deviation in the precharge voltages Vpre in sensing is also reduced. However, this method has a problem in that separate amplifiers need to be added and a problem in that the size of the sensing circuit is increased by the addition of the amplifiers. In spite of these problems, this technique may be applied to the present embodiment so as to improve performance.

Still another method capable of reducing a sensing error is to dispose amplifiers (for example, buffers) between the supply line VL and the respective sensing lines SL1 and SL2. When the buffers are disposed, a current hardly flows to an input terminal of each amplifier. Therefore, the above-described problem due to a deviation in the precharge voltages Vpre may be rarely caused.

By disposing the amplifiers for the respective sensing lines SL1 and SL2, a crosstalk between the sensing lines SL1 and SL2 may also be prevented.

As illustrated in FIG. 3, when the precharge voltage Vpre is supplied to the sensing lines SL1 and SL2 in the general sensing circuit (when the switches SW are closed), the currents of the sensing lines SL1 and SL2 should flow as in a first path PT1, but in some cases, a crosstalk problem may be caused in that the current of one sensing line SL2 flows to the other sensing line SL1 as in a second path PT2.

By disposing the amplifiers for the respective sensing lines SL1 and SL2, the crosstalk problem may be prevented as the currents are blocked by the amplifiers.

However, in this method, since the amplifiers need to be additionally disposed for the respective sensing lines SL1 and SL2, a problem may be caused in that the size of the sensing circuit excessively increases.

A sensing circuit according to an embodiment may supply a precharge voltage to a sensing line by using an amplifier which is used in sensing. Accordingly, the sensing circuit according to the embodiment may obtain, without additionally disposing amplifiers, the same effect as that obtained when an amplifier is disposed for each sensing line.

Figure 4:
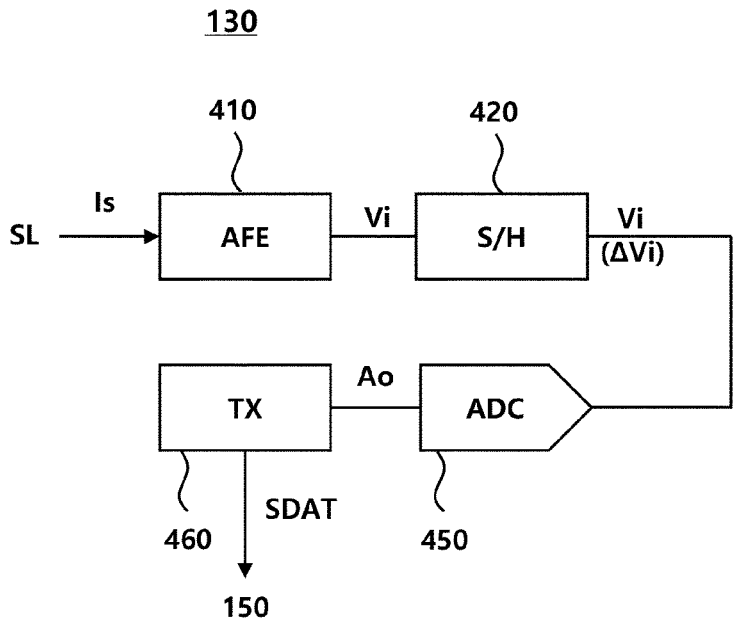
FIG. 4 is a configuration diagram of a sensing circuit in accordance with an embodiment.

FIG. 4 is a configuration diagram of a sensing circuit in accordance with an embodiment.

Referring to FIG. 4, the sensing circuit 130 may include an analog front end (AFE) 410, a sample and hold circuit (S/H) 420, an analog-to-digital converter (ADC) 450, and a transmitting circuit (TX) 460. The analog front end 410 and the sample and hold circuit 420 may configure a channel, and the sensing circuit 130 may include a plurality of channels.

The analog front end 410 may be connected to the sensing line SL, and may sense a pixel through the sensing line SL. The analog front end 410 may form a sensing voltage Vi by processing the sensing signal Is transferred from the sensing line SL. According to an embodiment, the sensing voltage Vi may be the same as a voltage obtained as a current transferred from the pixel is integrated. The analog front end 410 may transfer the sensing voltage Vi to the analog-to-digital converter 450.

The sample and hold circuit 420 may be disposed between the analog front end 410 and the analog-to-digital converter 450. The sample and hold circuit 420 may signally separate the analog front end 410 and the analog-to-digital converter 450, may temporarily store the sensing voltage Vi outputted from the analog front end 410, and may input the sensing voltage Vi or a difference ΔVi between the sensing voltage Vi and a reference voltage to the analog-to-digital converter 450.

The analog-to-digital converter 450 may convert the sensing voltage Vi or the difference ΔVi between the sensing voltage Vi and the reference voltage into digital data Ao.

The transmitting circuit 460 may generate the sensing data SDAT by processing the digital data Ao collected from the plurality of channels, and may transmit the sensing data SDAT to an external device (for example, the data processing circuit 150).

Figure 5:
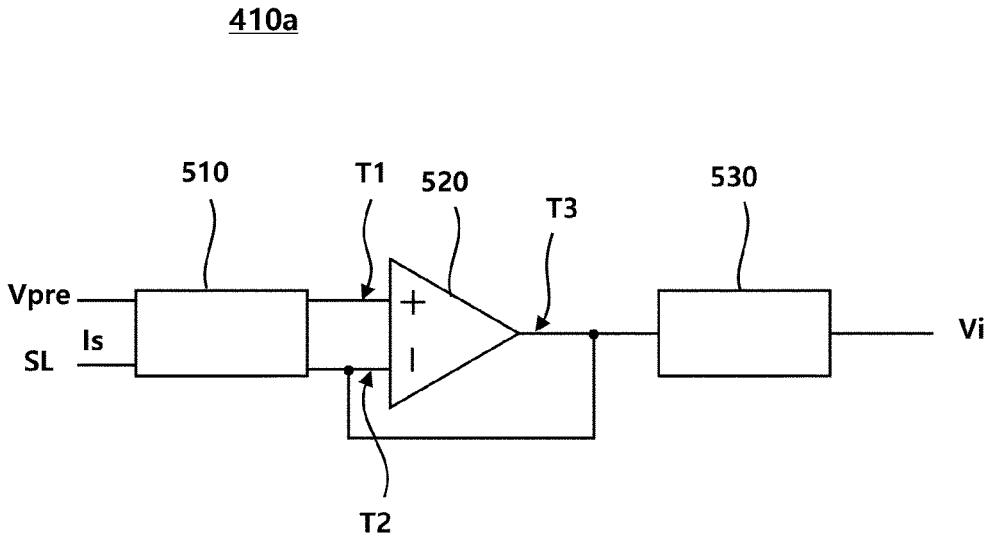
FIG. 5 is a configuration diagram illustrating a first example of an analog front end in accordance with an embodiment.

FIG. 5 is a configuration diagram illustrating a first example of an analog front end in accordance with an embodiment.

Referring to FIG. 5, an analog front end 410*a* may include a connection change circuit 510, an amplifier 520 and an additional circuit 530.

The amplifier 520 may include a first input terminal T1, a second input terminal T2 and an output terminal T3, and may operate as a buffer as the second input terminal T2 and the output terminal T3 are connected. The amplifier 520 may amplify a signal inputted to the first input terminal T1, and may supply the amplified signal to the output terminal T3. When the amplifier 520 operates as a buffer, a voltage of the signal inputted to the first input terminal T1 may be the same as a voltage of the output terminal T3, but an effect the same as that obtained when the first input terminal T1 and the output terminal T3 are electrically separated may be achieved.

The amplifier 520 may receive the precharge voltage Vpre and output the received precharge voltage Vpre to the sensing line SL during a first time, and may receive the sensing signal Is, formed in the pixel, through the sensing line SL and output the received sensing signal Is to the output terminal T3 during a second time. The first time and the second time may be different times, and the first time may precede the second time. The second time may be a time following the first time, and, after the sensing line SL is charged with the precharge voltage Vpre during the first time, the pixel may be sensed during the second time. Parasitic capacitance may be formed in the sensing line SL, and the use of the amplifier 520 may charge the parasitic capacitance.

In order to support such an operation of the amplifier 520, the connection change circuit 510 may change a connection state of circuits.

During the first time, the connection change circuit 510 may connect the precharge voltage Vpre to the first input terminal T1 and connect the sensing line SL to the second input terminal T2. During the second time, the connection change circuit 510 may release the connection to the precharge voltage Vpre, and may connect the sensing line SL to the first input terminal T1 instead of the second input terminal T2.

Through this operation, by using one amplifier 520, the analog front end 410*a* may supply the precharge voltage Vpre to the sensing line SL and receive the sensing signal Is from the sensing line SL.

The additional circuit 530, as a circuit which post-processes the sensing signal Is being an analog signal, may include a buffer or an integrator.

Figure 6:
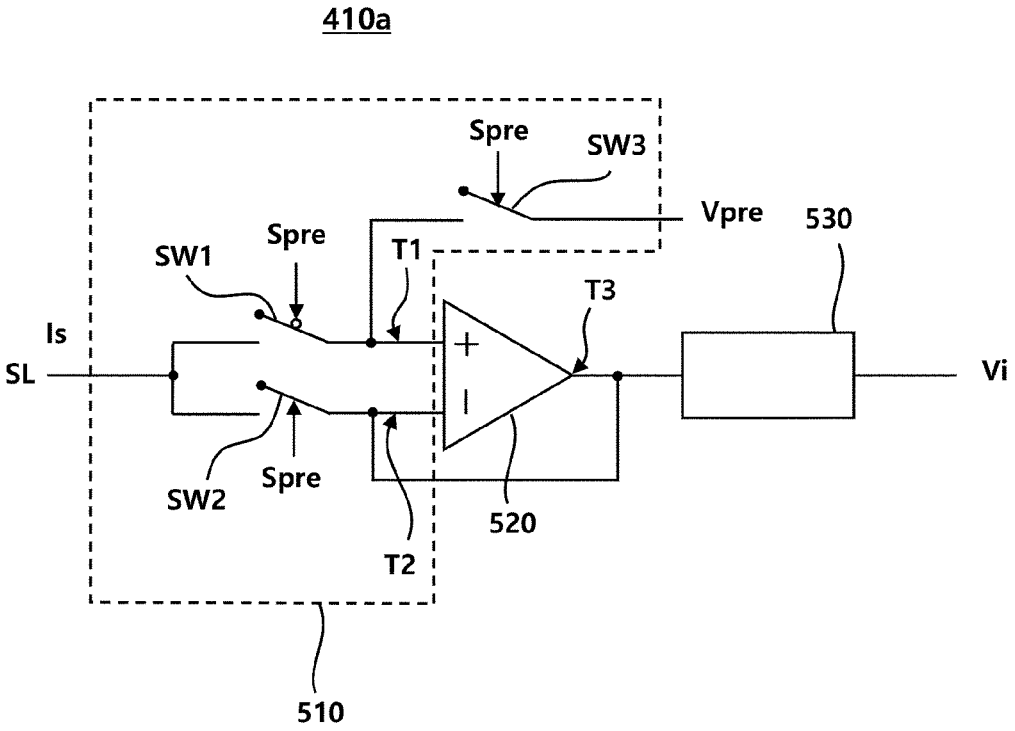
FIG. 6 is a configuration diagram of a connection change circuit according to the first example.

FIG. 6 is a configuration diagram of a connection change circuit according to the first example.

Referring to FIG. 6, the connection change circuit 510 may include three switches SW1, SW2 and SW3.

The first switch SW1 may control the connection between the first input terminal T1 of the amplifier 520 and the sensing line SL. The second switch SW2 may control the connection between the second input terminal T2 of the amplifier 520 and the sensing line SL. The third switch SW3 may control the connection between a supply line of the precharge voltage Vpre and the first input terminal T1 of the amplifier 520.

The second switch SW2 and the third switch SW3 may be opened (turned off) and then closed (turned on) depending on a switch signal Spre, and the first switch SW1 may be opened (turned off) and then closed (turned on) depending on an inverted signal of the switch signal Spre. The second and third switches SW2 and SW3 and the first switch SW1 may operate opposite to each other.

Figure 7:
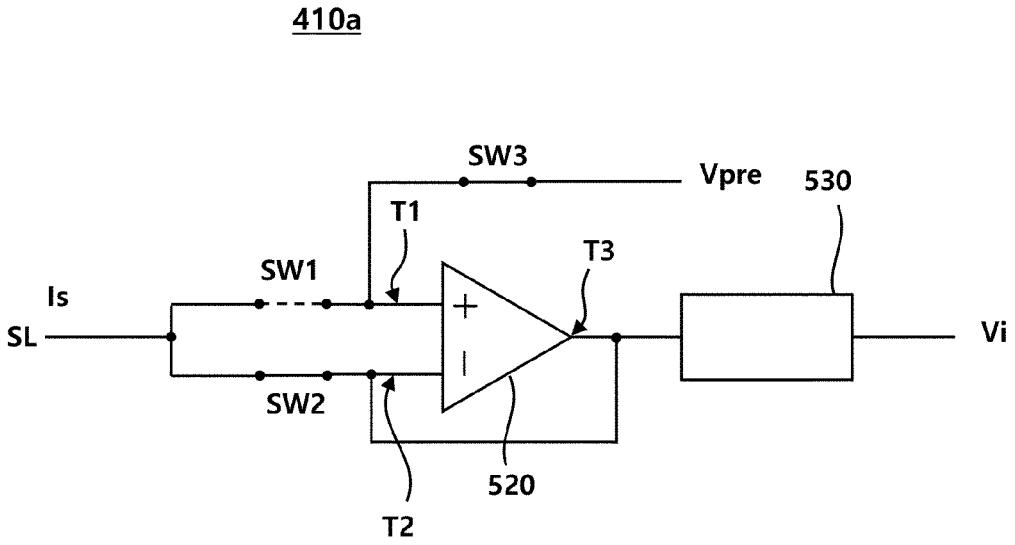
FIG. 7 is a first time state diagram of switches according to the first example.

FIG. 7 is a first time state diagram of switches according to the first example.

Referring to FIG. 7, during the first time, the first switch SW1 may be opened, and the second switch SW2 and the third switch SW3 may be closed. According to this state, the precharge voltage Vpre may be inputted to the first input terminal T1. The precharge voltage Vpre amplified by the amplifier 520 may be transferred to the sensing line SL through the output terminal T3, the second input terminal T2 and the second switch SW2.

Figure 8:
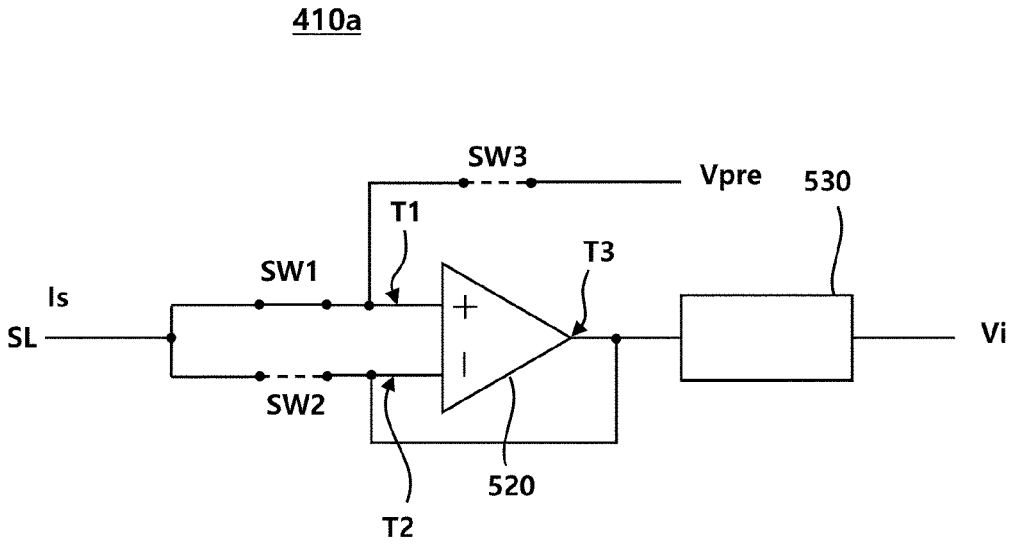
FIG. 8 is a second time state diagram of the switches according to the first example.

FIG. 8 is a second time state diagram of the switches according to the first example.

Referring to FIG. 8, during the second time, the first switch SW1 may be closed, and the second switch SW2 and the third switch SW3 may be opened. According to this state, the supply of the precharge voltage Vpre may be stopped. The sensing signal Is formed in the sensing line SL may be inputted to the first input terminal T1 of the amplifier 520 through the first switch SW1. The sensing signal Is amplified by the amplifier 520 may be outputted through the output terminal T3 of the amplifier 520.

Figure 9:
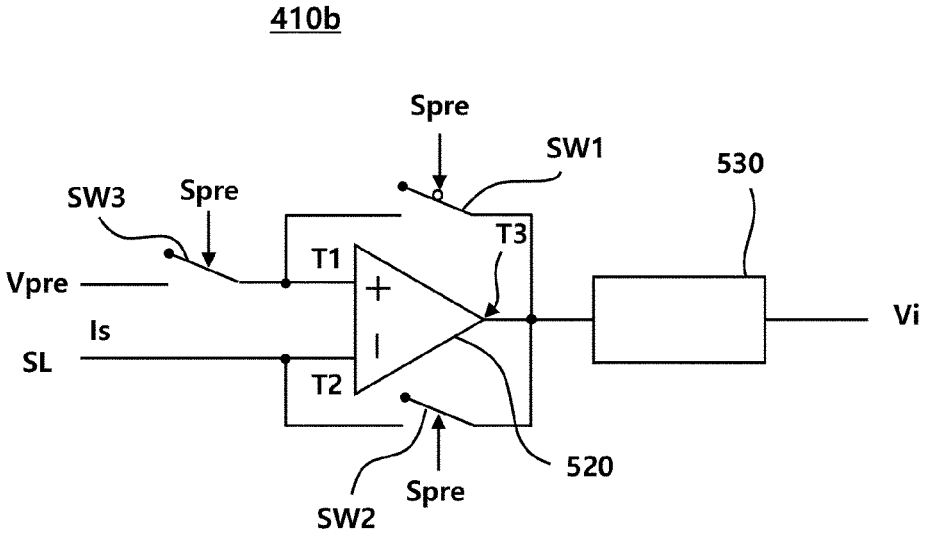
FIG. 9 is a configuration diagram illustrating a second example of the analog front end in accordance with the embodiment.

FIG. 9 is a configuration diagram illustrating a second example of the analog front end in accordance with the embodiment.

Referring to FIG. 9, an analog front end 410*b* may include three switches SW1, SW2 and SW3, an amplifier 520 and an additional circuit 530. The amplifier 520 may include a first input terminal T1, a second input terminal T2 and an output terminal T3.

The first switch SW1 may control the connection between the first input terminal T1 and the output terminal T3 of the amplifier 520. The second switch SW2 may control the connection between the second input terminal T2 and the output terminal T3 of the amplifier 520. The third switch SW3 may control the connection between a supply line of the precharge voltage Vpre and the first input terminal T1.

The amplifier 520 may receive the precharge voltage Vpre and output the received precharge voltage Vpre to the sensing line SL during a first time, and may receive the sensing signal Is, formed in the pixel, through the sensing line SL and output the received sensing signal Is to the output terminal T3 during a second time. The first time and the second time may be different times, and the first time may precede the second time.

During the first time, the first switch SW1 may be opened, and the second switch SW2 and the third switch SW3 may be closed. Accordingly, the precharge voltage Vpre may be inputted to the first input terminal T1. The precharge voltage Vpre amplified by the amplifier 520 may be transferred to the sensing line SL through the output terminal T3, the second switch SW2 and the second input terminal T2.

During the second time, the first switch SW1 may be closed, and the second switch SW2 and the third switch SW3 may be opened. According to this state, the supply of the precharge voltage Vpre may be stopped. The sensing signal Is formed in the sensing line SL may be inputted to the second input terminal T2 of the amplifier 520. The sensing signal Is amplified by the amplifier 520 may be outputted through the output terminal T3 of the amplifier 520.

As is apparent from the above description, according to the embodiments, it is possible to increase the accuracy of pixel sensing by minimizing a deviation between respective sensing lines. Also, according to the embodiments, it is possible to minimize a deviation in precharge voltages of respective sensing lines and solve a crosstalk problem between sensing lines. Further, according to the embodiments, it is possible to achieve the above effects while minimizing an increase in the size of a pixel sensing device.

What is claimed is:

1. A pixel sensing device for sensing a pixel, disposed in a panel, through a sensing line, the pixel sensing device comprising:

an amplifier configured to output a precharge voltage to the sensing line during a first time and to receive a sensing signal, formed in the pixel, through the sensing line and to output the received sensing signal as a sensing voltage during a second time;

a first switch configured to selectively connect a first input terminal of the amplifier and the sensing line; and a second switch configured to selectively connect a second input terminal of the amplifier and the sensing line, wherein a plurality of sensing lines are connected to different positions of a line, through which the precharge voltage is supplied, and at least two sensing lines are simultaneously supplied with the precharge voltage through the line.

2. The pixel sensing device of claim 1, wherein, during the first time, the precharge voltage is inputted through a first input terminal of the amplifier and a second input terminal and an output terminal of the amplifier are connected to the sensing line and, during the second time, the sensing line is connected to the first input terminal and the second input terminal and the output terminal are connected with the analog-to-digital converter.

3. The pixel sensing device of claim 1, further comprising: a third switch configured to connect a line, through which the precharge voltage is supplied, and the first input terminal of the amplifier, wherein the second input terminal and an output terminal of the amplifier are connected with each other.

4. The pixel sensing device of claim 3, wherein, during the first time, the first switch is opened and the second switch and the third switch are closed and, during the second time, the first switch is closed and the second switch and the third switch are opened.

5. The pixel sensing device of claim 1, wherein the second time follows the first time.

6. The pixel sensing device of claim 1, further comprising:

an analog-to-digital converter configured to convert the sensing voltage into digital data; and a transmitting circuit configured to transmit the digital data to a device which compensates for image data for the pixel.

7. A pixel sensing device for sensing a pixel, disposed in a panel, through a sensing line, the pixel sensing device comprising:

an amplifier configured to output a precharge voltage to the sensing line during a first time and to receive a sensing signal, formed in the pixel, through the sensing line and to output the received sensing signal as a sensing voltage during a second time;

a first switch configured to connect a first input terminal and an output terminal of the amplifier;

a second switch configured to connect a second input terminal and the output terminal of the amplifier; and a third switch configured to connect a line, through which the precharge voltage is supplied, and the first input terminal of the amplifier, wherein the sensing line is connected to the second input terminal of the amplifier.

8. The pixel sensing device of claim 7, wherein, during the first time, the first switch is opened and the second switch and the third switch are closed and, during the second time, the first switch is closed and the second switch and the third switch are opened.

9. A panel driving device for driving a panel in which a plurality of pixels are disposed and a plurality of data lines and a plurality of sensing lines connected to the pixels are disposed, the panel driving device comprising:

a data driving circuit configured to convert image data into a data voltage and to supply the data voltage to a data line; and a pixel sensing circuit configured to generate sensing data corresponding to a sensing signal formed in a pixel, wherein the image data is compensated according to the sensing data, wherein the pixel sensing circuit comprises an amplifier which, during a first time, outputs a precharge voltage to the sensing line connected to the pixel and, during a second time, receives the sensing signal, formed in the pixel, through the sensing line and outputs the sensing signal to an analog-to-digital converter; and a connection change circuit which, during the first time, transfers the precharge voltage to the first input terminal and connects the sensing line to the second input terminal and, during the second time, releases the connection to the precharge voltage and connects the sensing line to the first input terminal instead of the second input terminal.

10. The panel driving device of claim 9, wherein the pixel comprises an organic light-emitting diode (OLED).

11. The panel driving device of claim 10, wherein the pixel sensing circuit is connected to a contact node between the organic light-emitting diode and a driving transistor, which supplies a driving current to the organic light-emitting diode, and receives a current flowing to the driving transistor, a current flowing to the organic light-emitting diode, or a voltage formed in the contact node in a form of an electrical signal.

12. The panel driving device of claim 9, wherein the plurality of sensing lines are connected to different positions of a line to which the precharge voltage is supplied and at least two sensing lines are simultaneously supplied with the precharge voltage through the line.

13. The panel driving device of claim 9, wherein the connection change circuit further comprises a first switch configured to connect a first input terminal of the amplifier and the sensing line, a second switch configured to connect a second input terminal of the amplifier and the sensing line, and a third switch configured to connect a line to which the precharge voltage is supplied and the first input terminal of the amplifier, wherein the second input terminal and an output terminal of the amplifier are connected.

14. The panel driving device of claim 13, wherein the first switch is opened and the second switch and the third switch are closed during the first time and the first switch is closed and the second switch and the third switch are opened during the second time.

15. The panel driving device of claim 9, wherein the connection change circuit further comprises a first switch configured to connect a first input terminal and an output terminal of the amplifier, a second switch configured to connect a second input terminal and the output terminal of the amplifier, and a third switch configured to connect a line to which the precharge voltage is supplied and the first input terminal of the amplifier, wherein the sensing line is connected to the second input terminal of the amplifier.

16. The panel driving device of claim 15, wherein the first switch is opened and the second switch and the third switch are closed during the first time and the first switch is closed and the second switch and the third switch are opened during the second time.

* * * * *